US012389970B2

(12) United States Patent
Tiscareno et al.

(10) Patent No.: US 12,389,970 B2
(45) Date of Patent: Aug. 19, 2025

(54) CUSTOMIZABLE SNAP COVER FOR OPEN FACE HELMETS

(71) Applicants: Ernesto Tiscareno, Pixley, CA (US); Daniel J. Reetz, Sherman Oaks, CA (US)

(72) Inventors: Ernesto Tiscareno, Pixley, CA (US); Daniel J. Reetz, Sherman Oaks, CA (US)

( * ) Notice: Subject to any disclaimer, the term of this patent is extended or adjusted under 35 U.S.C. 154(b) by 5 days.

(21) Appl. No.: 18/100,202

(22) Filed: Jan. 23, 2023

(65) Prior Publication Data

US 2023/0232930 A1 Jul. 27, 2023

Related U.S. Application Data

(60) Provisional application No. 63/302,255, filed on Jan. 24, 2022.

(51) Int. Cl.
*A42B 3/22* (2006.01)
*A42B 3/04* (2006.01)

(52) U.S. Cl.
CPC ..... *A42B 3/221* (2013.01)

(58) Field of Classification Search
CPC ..... A42B 3/221; A42B 3/0406
See application file for complete search history.

(56) References Cited

U.S. PATENT DOCUMENTS 4,495,657 A * 1/1985 Bay ..... A42B 3/221 2/10
5,070,545 A * 12/1991 Tapia ..... A42B 1/0184 2/171.1
5,613,246 A * 3/1997 Alexander ..... A42B 1/0184 2/10
5,901,380 A * 5/1999 Mishal ..... A42B 1/0187 2/202
5,953,760 A * 9/1999 Powell ..... A42B 3/221 2/10
6,044,495 A * 4/2000 Ellman ..... A42B 1/0184 2/209.13
6,237,156 B1 * 5/2001 Ellman ..... A42B 1/0184 40/329
6,385,776 B2 * 5/2002 Linday ..... A42B 1/0187 2/171.1
6,389,595 B1 * 5/2002 Hunter ..... A61F 9/06 351/155

(Continued)

*Primary Examiner* — Robert H Muromoto, Jr.
(74) *Attorney, Agent, or Firm* — Snell & Wilmer L.L.P.

(57) ABSTRACT

A snap cover assembly for use with open face helmets that allows for easy mounting onto the helmet via the helmets visor or face shield snaps, e.g., a series of three male snaps protruding from the helmet's outer surface immediately above the facial or front opening. The assembly includes an inner element (or "mounting element") configured with a mounting assembly or system for attaching the snap cover assembly to the exposed helmet snaps. The assembly further includes an outer element, which is coupled with an outer surface of the inner element in a manner, in some embodiments, that allows it to be removable to allow a user to swap it out to modify the look of their helmet. The outer element includes an outer surface (or customization surface) upon which one or more customizations (or customizing elements) may be provided by the user or others.

15 Claims, 12 Drawing Sheets

(56) References Cited

U.S. PATENT DOCUMENTS 6,557,180 B2 * 5/2003 Hall McKenzie ... A42B 1/0184 2/209.12
6,993,794 B2 * 2/2006 Hall ..... A42B 1/206 2/209.12
7,044,531 B2 * 5/2006 Schaad ..... B60J 3/0204 296/97.5
7,216,918 B1 * 5/2007 Runfola ..... B60R 11/00 296/97.11
8,627,516 B2 * 1/2014 Evans ..... A61F 9/045 2/244
9,402,433 B2 * 8/2016 York ..... A42B 1/24
9,848,665 B2 * 12/2017 Gendron ..... F41H 1/04
11,000,080 B1 * 5/2021 Hall ..... A41D 13/1107
2004/0093658 A1 * 5/2004 Jackson ..... A61F 9/045 2/200.1
2005/0251894 A1 * 11/2005 Marsh ..... A42B 1/22 2/195.3
2006/0277658 A1 * 12/2006 Marsh ..... A42B 1/24 2/171
2007/0115425 A1 * 5/2007 Englebright ..... G02C 9/00 351/44
2007/0256213 A1 * 11/2007 Dunavin ..... A42B 1/248 2/171
2008/0115257 A1 * 5/2008 Hernandez ..... A42B 1/0184 2/195.2
2008/0115258 A1 * 5/2008 Hernandez ..... A42B 1/0184 2/209.12
2010/0107308 A1 * 5/2010 Hosie ..... A42B 7/00 2/209.12
2010/0306905 A1 * 12/2010 Cornell ..... A42B 3/227 2/10
2012/0054936 A1 * 3/2012 Cornell ..... A42B 3/227 2/9
2012/0210493 A1 * 8/2012 Evans ..... A42B 1/004 2/209.13
2014/0259254 A1 * 9/2014 King ..... A42B 3/221 2/15
2015/0135406 A1 * 5/2015 Nguyen ..... A42B 1/205 2/209.12
2015/0181971 A1 * 7/2015 York ..... A42B 1/22 2/209.3
2015/0250252 A1 * 9/2015 Wako ..... F16B 21/02 403/349
2016/0029734 A1 * 2/2016 Kurpjuweit ..... A42B 3/205 2/427
2017/0245572 A1 * 8/2017 Han ..... A63H 33/086
2018/0092419 A1 * 4/2018 Banducci ..... A42B 3/04
2018/0146734 A1 * 5/2018 Kelly ..... A42B 1/004
2019/0029351 A1 * 1/2019 Pleil ..... A42B 1/18
2019/0036483 A1 * 1/2019 Kelly ..... A42B 1/004
2021/0251326 A1 * 8/2021 Smith, III ..... A42B 1/0184

* cited by examiner

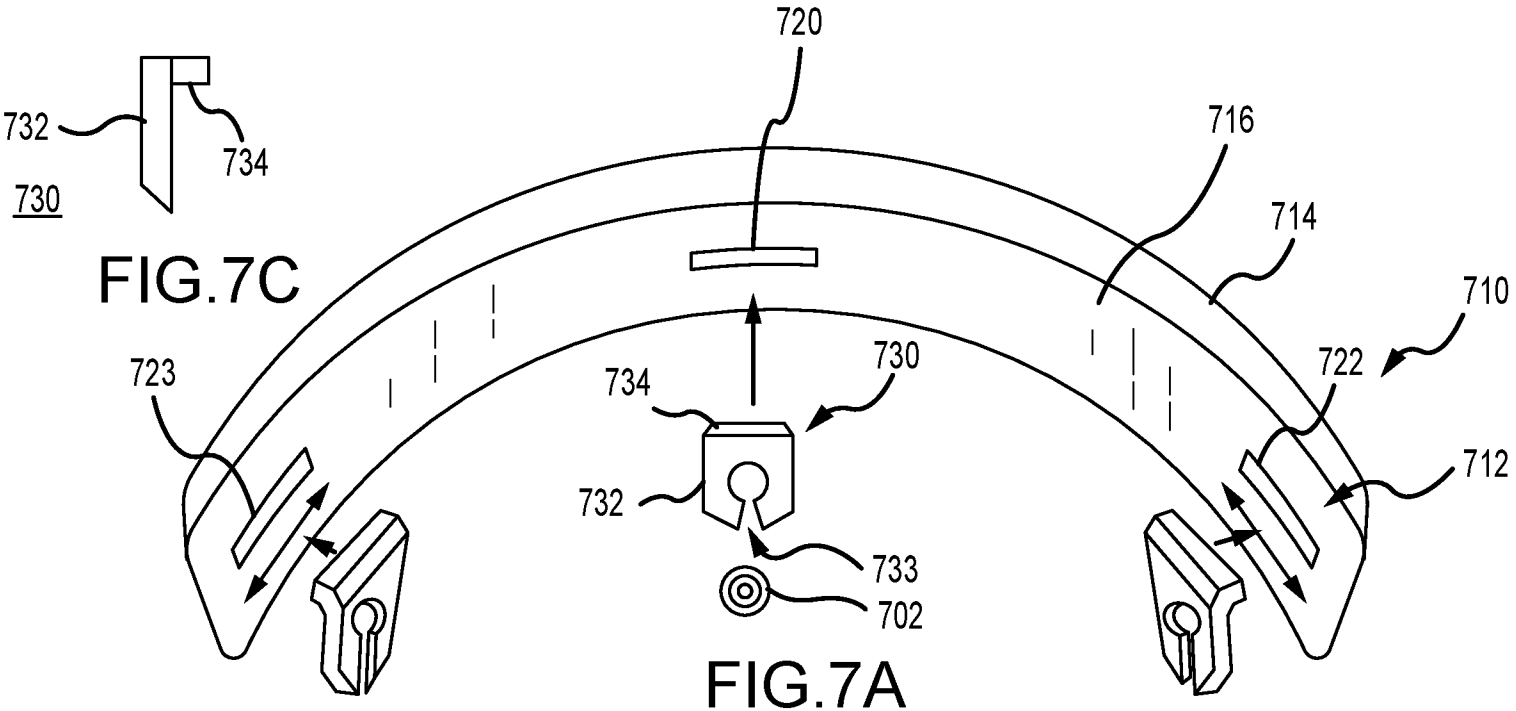
FIG.7A
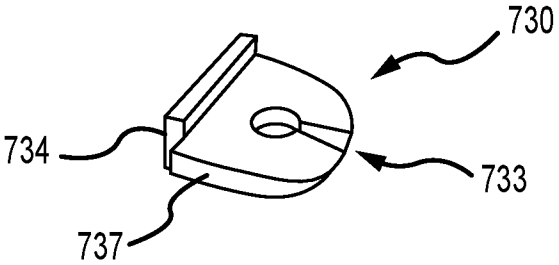
FIG.7B
FIG.7C

CUSTOMIZABLE SNAP COVER FOR OPEN FACE HELMETS

CROSS REFERENCE TO RELATED APPLICATIONS

This application claims priority to U.S. Provisional Pat. Appl. No. 63/302,255, filed Jan. 24, 2022, which is incorporated herein by reference in its entirety.

FIELD OF THE INVENTION

The present description is directed toward safety or crash helmets and accessories for such helmets, and, more particularly, to a snap cover assembly for use in customizing a helmet, such as open face motorcycle helmets and the like, that include a series of external snaps to allow for installation, removal, and replacement of a snap-on visor or face shield.

BACKGROUND

There are many settings in which a crash helmet is worn to enhance safety of an activity such as a driver or rider of a motorized vehicle. For example, many countries require that riders of motorized vehicles that are unenclosed wear helmets for safety. A motorcycle helmet is an example of these crash or safety helmet, which are designed to improve motorcycle safety by protecting the rider's head in the event of an impact. Motorcycle helmets are often formed to have a polystyrene foam inner shell that absorbs the shock of an impact, and a protective plastic outer layer.

One common form of such helmets is an open face or three-quarters helmet that is designed to cover the ears, cheeks, and back of the wearer's head. Many open face helmets offer snap-on visors or face shields that may be used by the rider to reduce sunlight glare. To allow the visors to be snapped on and off, the outer surface of the helmet typically includes three spaced-apart male snaps adjacent an upper edge of the facial or front opening of the helmet. Many vehicle operators including motorcycle riders remove the visor or face shield to enhance comfort or improve visibility and rely upon sunglasses or goggles to provide eye protection with open face helmets, leaving the snaps exposed.

While helmets come in a wide variety of colors and graphic designs, many riders enjoy customizing their helmets rather than using an off-the-shelf design. Helmet customizations are wide ranging and include decals or stickers, snap-on visors and face shields, and sculptural additions. These customizations may be applied to the helmet outer surface in the form of decals or stickers or in a three-dimensional (3D) form such as a faux mohawk, spikes, or animal ears. In other cases, the rider may swap out the snap-on visor for a custom-molded sun visor or the like or the rider may apply vinyl stickers to the visor.

There is a demand for new ways to customize the look of an open face helmet. This demand remains, in part, because existing customizations can reduce safety such as when a rider applies a vinyl sticker to a visor, thereby at least partially blocking the wearer's view. The demand for new customizations is also from riders who often remove their visor, such as in warmer weather, and who do not like the look of the exposed set of snaps above the facial or front opening.

SUMMARY

To address the need or demand for new helmet customizations, the inventor designed a snap cover assembly for use with open face helmets that allows for easy mounting onto the helmet via the helmets visor or face shield snaps, e.g., a series of three male snaps protruding from the helmet's outer surface immediately above the facial or front opening. The assembly includes an inner element (or "mounting element") configured with a mounting assembly or system for attaching the snap cover assembly to the exposed helmet snaps. The assembly further includes an outer element, which is coupled with an outer surface of the inner element in a manner, in some embodiments, that allows it to be removable to allow a user to swap it out to modify the look of their helmet. The outer element includes an outer surface (or customization surface) upon which one or more customizations (or customizing elements) may be provided by the user or others (e.g., a manufacturer, a distributor, or the like).

The new snap cover assembly has several desirable features or aspects that are likely to cause it to be widely accepted and used by riders, i.e., helmet wearers or users. First, it allows the wearer to uniquely identify or individualize their helmets via a detachable means. Particularly, the customization or customizing element may be graphical, textual, symbolic, and/or optical or a combination of all these types of customizations. Second, the snap cover assembly is useful for hiding the exposed visor snaps, which many helmet users believe are unsightly or undesirable. Third, the use of the snap cover assembly is safer than other customizations that involve modifying or covering the visor or face shield, which can block the user's view or distract the user during vehicle operations.

More particularly, a snap cover assembly is provided for use with open face helmets. The assembly includes an inner mounting element with a semi-cylindrical body having an inner surface and an outer surface. An outer customization element is included with a semi-cylindrical body attached to or integrally formed with the outer surface of the body of the inner mounting element. The body of the outer customization element may include a customization surface opposite the inner mounting element that is configured for receiving or containing one or more customizing elements. The assembly further includes a set of spaced-apart slots provided in the inner surface of the inner mounting element that are configured for receiving a set of snaps provided on an outer surface of an open face helmet for coupling with a visor or face shield.

In some embodiments of the snap cover assembly, each of the slots is defined by a flexible sidewall configured for providing a snap fit with one of the snaps. In these implementations of an integral snap coupling mechanism, the flexible sidewall is angled inward from the outer surface to the inner surface of the body of the inner mounting element to provide the snap fit.

To provide alignment with the snaps that may have different positions on helmets, each of the slots may have a length that is at least 1.5 times greater than a maximum outer diameter of the snaps. In a more specific example implementation, the set of slots may include three elongated slots with a center slot positioned proximate to a center of the body of the inner mounting element and being arranged with a longitudinal axis substantially orthogonal to a longitudinal axis of the body of the inner mounting element. The three elongated slots also may include a pair of outer slots positioned with one on either side of the center slot and each oriented with a longitudinal axis substantially parallel to the longitudinal axis of the body of the inner mounting element.

The assembly may be configured to include a snap coupling device slidably disposed within each of the slots. The snap coupling device is selected from the following: a female or male snap configured for mating with the snap of the helmet, a press-on washer, a split washer, a metal flexure, and a metal flexible coupling device. further comprising a suction cup disposed within each of the slots that is oriented and configured for mating with the outer surface of the helmet. In some embodiments, the assembly further includes one or more patches of or a layer of flexible adhesive on the inner surface of the mounting element.

The assembly may also include a customizing element attached to or provided as part of the customization surface. In such implementations of the snap cover assembly, the customizing element is a customization selected from the following: a retroreflector or layer of retroreflective material, a sticker, a decal, a layer of ink, a layer of paint, a three dimensional (3D) component, an embossed element, a molded element, a feature configured for providing public safety information, a feature providing colors or symbols invoking escort or group leader functions or worker authority, a component providing advertisement functions, a component configured to individualize or identify the helmet or person wearing the helmet, and a customization with an outer layer or coating of weather resistant material.

The foregoing is a summary and thus may contain simplifications, generalizations, and omissions of detail; consequently, those skilled in the art will appreciate that the summary is illustrative only and is not intended to be in any way limiting. For a better understanding of the embodiments, together with other and further features and advantages thereof, reference is made to the following description, taken in conjunction with the accompanying drawings. The scope of the embodiments will be pointed out in the appended claims.

BRIEF DESCRIPTION OF THE DRAWINGS

FIGS. 7A-7C illustrate an exploded view of another snap cover assembly along with a perspective rear view and a side view of a slide-in lock clamp of the assembly.

DETAILED DESCRIPTION

In brief, the present description teaches a snap cover assembly for use in customizing open face helmets, including motorcycle helmets, that are designed to receive a snap-on visor or face shield. In brief, the assembly is configured for detachable mounting upon an outer surface of a helmet above the facial or front opening of a helmet. To this end, the assembly includes an inner or mounting element (or cover or cover body) with a mounting assembly or system adapted to detachably engage with the set of visor/shield snaps (exposed due to removal of the helmet's visor or face shield). The snap cover assembly also includes an outer element (or covering layer) that is permanently or detachably attached to an outer surface of the inner or mounting element, and the outer element includes a customization surface adapted for receiving one or more customizations or customizing elements.

Figure 1:
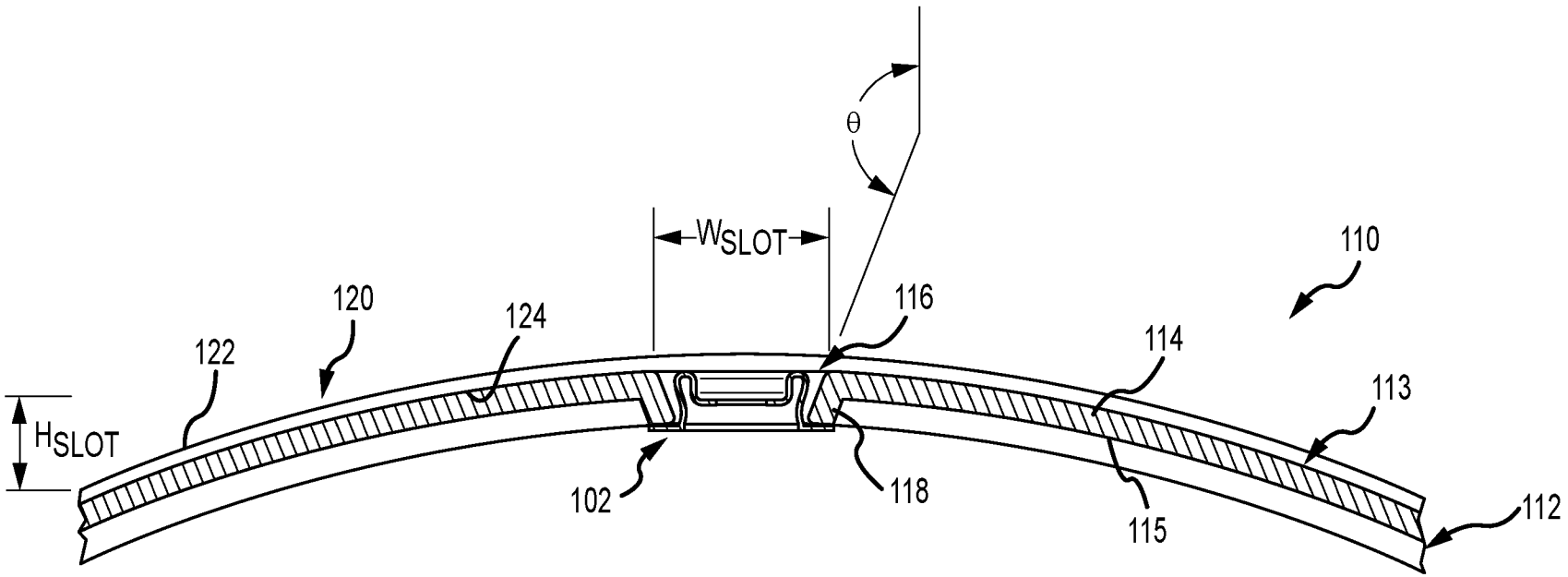
FIG. 1 illustrates a side sectional view of a portion of a snap cover assembly of the present description showing mating with a single visor or face shield snap of a helmet.

FIG. 1 illustrates a side sectional view of a portion of a snap cover assembly 110 of the present description showing it mating with a single visor or face shield snap 102 of a helmet (not shown in FIG. 1). As shown, the snap cover assembly 110 includes an inner or mounting element 112 with a body 113 having an outer or top surface (or side) 114 and an inner or bottom surface (or side) 115. The body 113 may be formed of flexible and durable material such as of plastic with a thickness in the range of 0.1 to 0.25 inches or the like. The snap cover assembly 110 further includes an outer element (or covering layer) 120, with an inner surface (or side) 122 and an outer or customization surface 124 upon which one or more customization or customizing elements (not shown in FIG. 1) may be provided. The outer element 120 is arranged with its inner surface/side 122 facing and mated with the outer or top surface 114 of the body 113 of the inner or mounting element 112.

The inner or mounting element 112 includes a slot or passageway for receiving each of a set of visor or face shield snap on a helmet's outer surface. As shown, the inner element 112 includes a slot or passageway 116 that has received a male snap 102, with a typical motorcycle helmet including three such snaps spaced apart generally in a line above the facial or front opening to allow a visor or face shield with three female snaps to be snapped on and off (here shown with the visor or face shield removed or snapped off the helmet).

The slot 116 is defined by a sidewall 118 that extends about its periphery, and the slot 116 may be generally rectangular in shape with a width, $W_{Slot}$, chosen based on a maximum outer diameter (OD) of the snap 102. As shown, the sidewall 118 may be angled inward from the outer or top surface 114 to the inner or bottom surface 115 rather than being vertical such as at an angle, θ, in the range of 135 to 175 degrees such that the sidewall 118 captures, e.g., by flexing open upon insertion of the snap 102 and then flexing or snapping closed (as shown) to capture or snap onto the narrower portion of the male snap 102. The height, $H_{Slot}$, may be chosen to match that of the snap 102 or be a small amount larger such that the top of the snap 102 does not abut the inner surface 124 of the cover layer 120. In some cases, the slot or snap receiving feature 116 is provided its ability to capture a snap 102 by the flexibility and resilient (or spring-like) characteristics, which may be provided by forming (e.g., molding) the inner or mounting element 112 of a plastic or similar material with a thickness in the range discussed above.

Figure 2A:
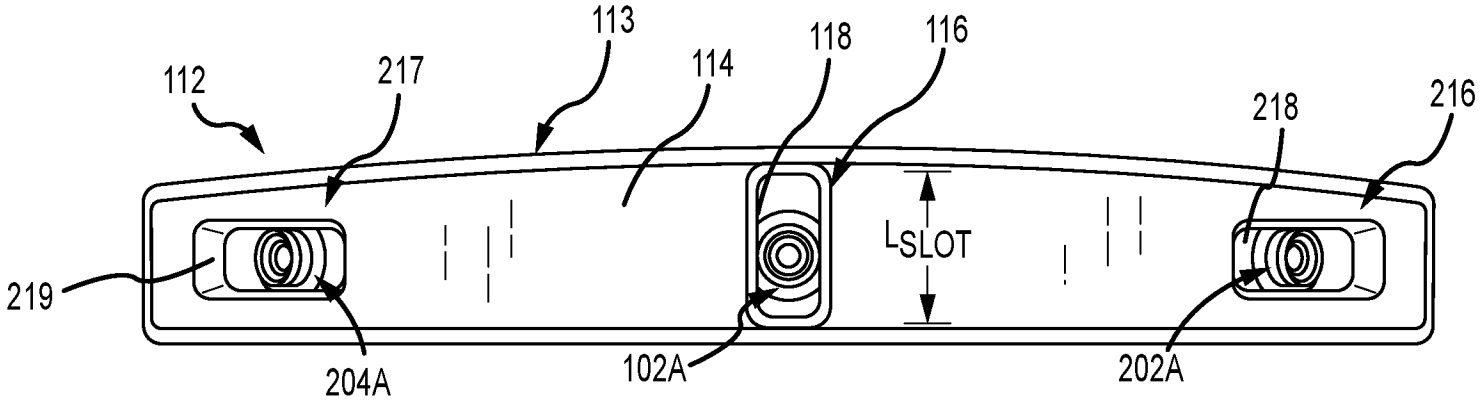
FIGS. 2A and 2B illustrate the inner or mounting element (or cover or cover body) of the snap cover assembly of FIG. 1 in use with two different sets of helmet snaps having a different pattern or placement.
Figure 2B:
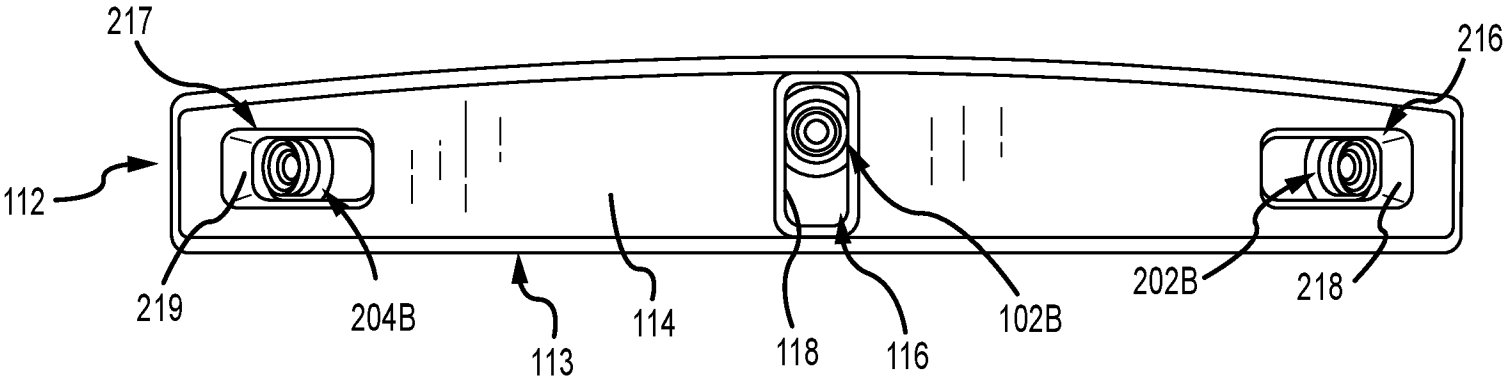

FIGS. 2A and 2B illustrate the inner or mounting element (or cover or cover body) 112 of the snap cover assembly 110 of FIG. 1 in use with two different sets of helmet snaps having different patterns or placement. Particularly, the snap pattern for a visor or face shield may vary with the size of the helmet, with the manufacturer of the helmet, and due to manufacturing tolerances. With this in mind, the snap cover assembly 110 is designed to be used with a wide range of snap patterns or spacings through the use of slots that allow for different snap patterns or spacings rather than use of a set of circular holes.

This slot arrangement and its usefulness is shown in FIGS. 2A and 2B with the snap cover assembly 110 being used with two sets of visor or face shield snaps as may be found on two different helmets (not shown). In these figures, the outer or customization element 120 has been removed from the assembly 110 to expose the outer or top surface 114 of the body 113 of the top or mounting element 112 after it has been mated with two different series or set of three helmet snaps, with the first set including snaps 102A, 202A, and 204A and the second set including snaps 102B, 202B, and 204B that are shown to have differing positions or to be arranged with a slightly differing spacing or pattern. As shown, the snaps may vary in either or both vertical and horizontal spacing.

To address these different snap positions, the inner or mounting element 112 includes a center slot 116 and two outer or side slots 216 and 217. Each has a width as discussed above to facilitate receiving a snap and with snapping onto or flexibly engaging that snap. Further, though, each of the slots 116, 216, and 217 has a length, $L_{Slot}$, that is greater than the maximum OD of the snaps to allow for the differing snap spacings and/or positioning patterns, and the length, $L_{Slot}$, may be in the range of 1.5 to 4 times (or 150 to 400 percent of) the OD of the snaps. The length, $L_{Slot}$, may be the same for all three of the slots 116, 216, 217 or they may vary (such as with the side slots 216 and 217 having a greater length than the inner or center slot 116 in some embodiments). Further, alignment is achieved by orienting the center slot 116 vertically (i.e., with its longitudinal axis orthogonal to the longitudinal axis of the body 113 of the inner element 112) and the side or outer slots 216 and 217 horizontally (i.e., with their longitudinal axes parallel to the longitudinal axis of the body 113 of the inner element 112). In this way, the centering slot's sidewall 118 acts to retain the horizontal position of the body 113 while the outer slot sidewalls 218 and 219 act to retain the vertical position of the body 113 on the helmet (or relative to the received snaps). As shown, this configuration allows the first set of snaps 102A, 202A, 204A and the second set of snaps 102B, 202B, and 204B both being received within the slots 116, 216, 217, thereby allowing the inner element 112 to be snapped onto helmets with the two differing patterns or positioning of snaps.

Figure 3:
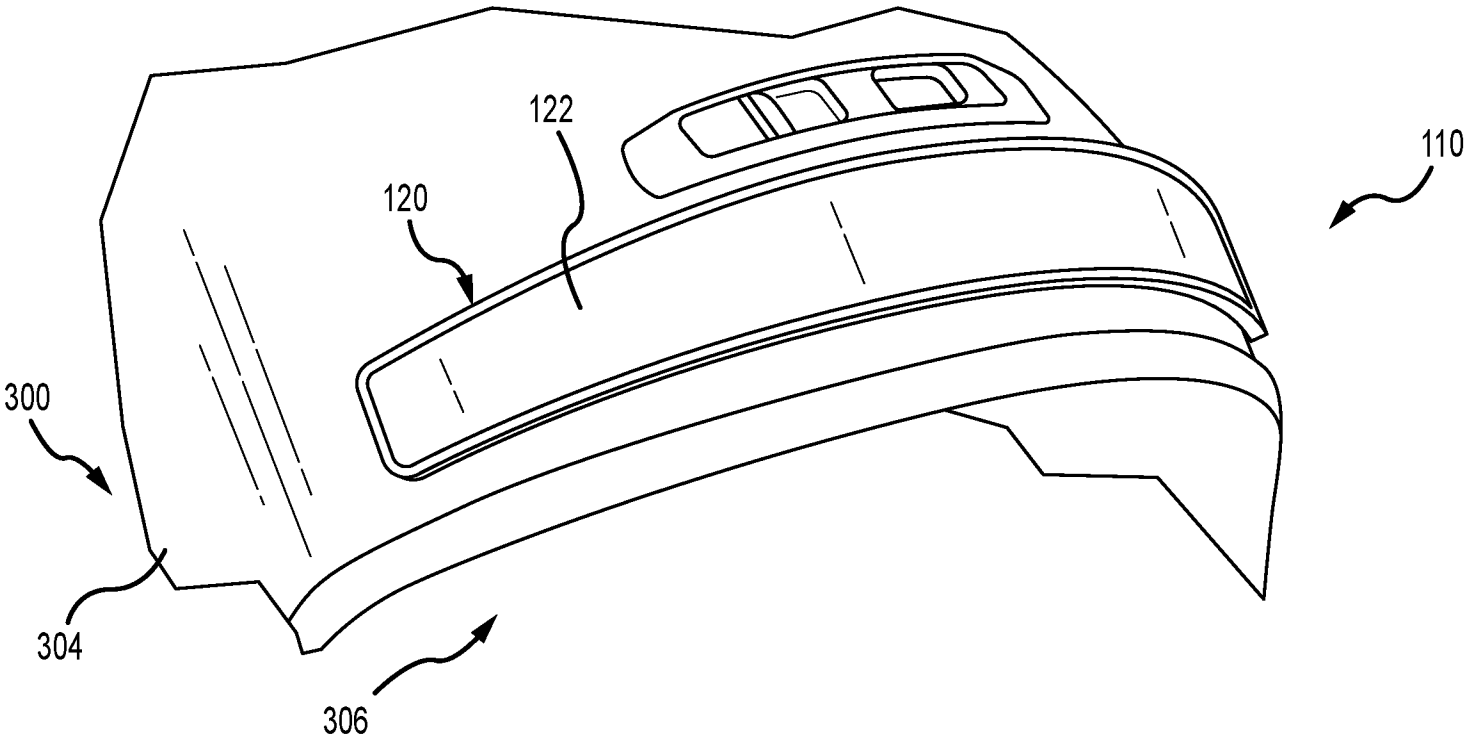
FIG. 3 illustrates the snap cover assembly of FIG. 1 after application onto a helmet showing only the relevant upper front portion of the helmet.

FIG. 3 illustrates the snap cover assembly 110 of FIG. 1 after application onto a helmet 300. The helmet 300 is an open face design with an outer surface 304 or shell and with a facial or front opening 306, and a set of three snaps are provided on the surface 304 above and proximate to the opening 306 (such as in an arc along the opening 306 and offset from the opening by a small distance such as by 0.5 to 1 inch or the like). The snaps are hidden from view in FIG. 3 by the snap cover assembly 110, which, as discussed with reference to FIGS. 1-2B is attached to the surface 304 via a detachable coupling between the three snaps and the three slots 116, 216, and 217 of the inner or mounting element 112.

The cover layer or outer element 120 is useful in the snap cover assembly 110 for providing a semi-cylindrical customization surface 122 upon which one or more customizations or customization elements, e.g., stickers, decals, integrally formed or later attached 3D features, or the like, may be provided. In this manner, the surface 122 hides the presence of the snaps but is spaced apart from the helmet surface 304 such that it does not interfere with the snaps. The snap cover assembly 110 may be removed with a prying motion, and a visor or face shield or the assembly 110 (or another embodiment of a snap cover assembly) may be attached to the helmet surface 304.

Figure 4A:
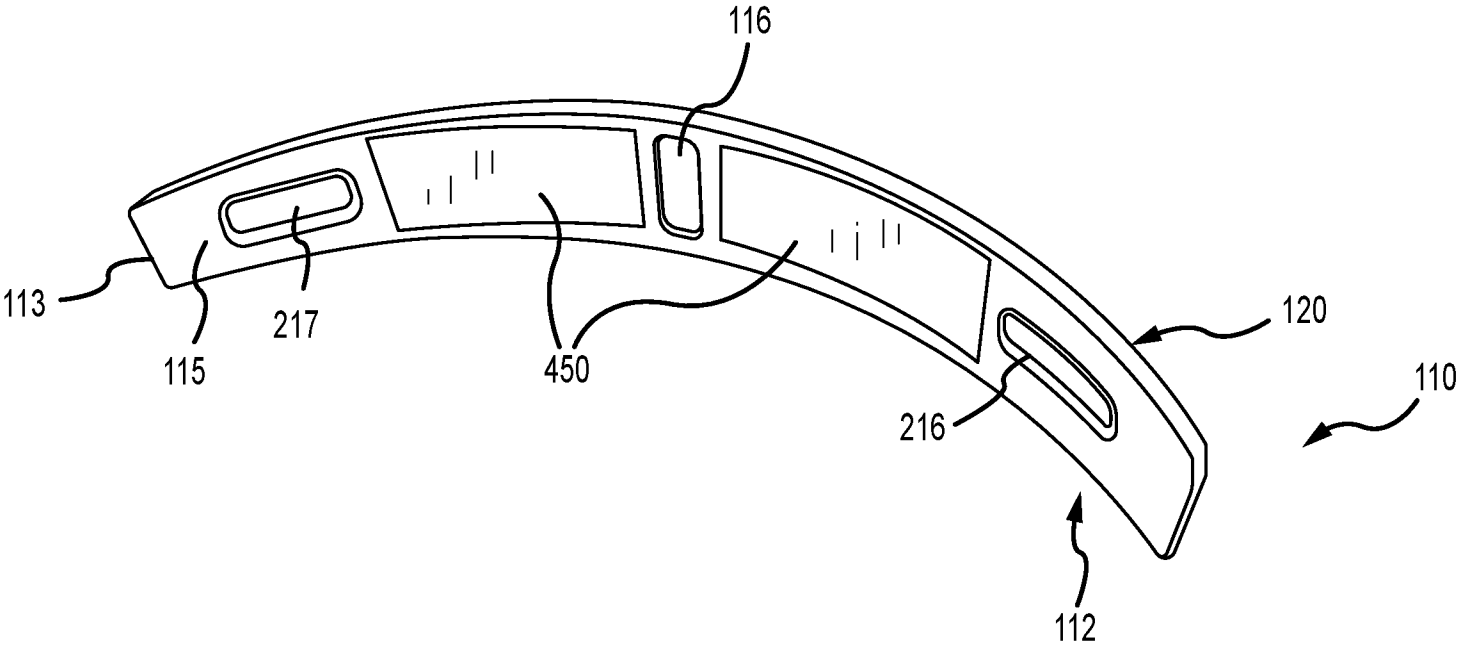
FIGS. 4A-4F illustrate various attachment means that may be used with the snap cover assembly of FIG. 1 in addition or in place of the slots with flexible and sloped sidewalls in the inner or mounting element.
Figure 4B:
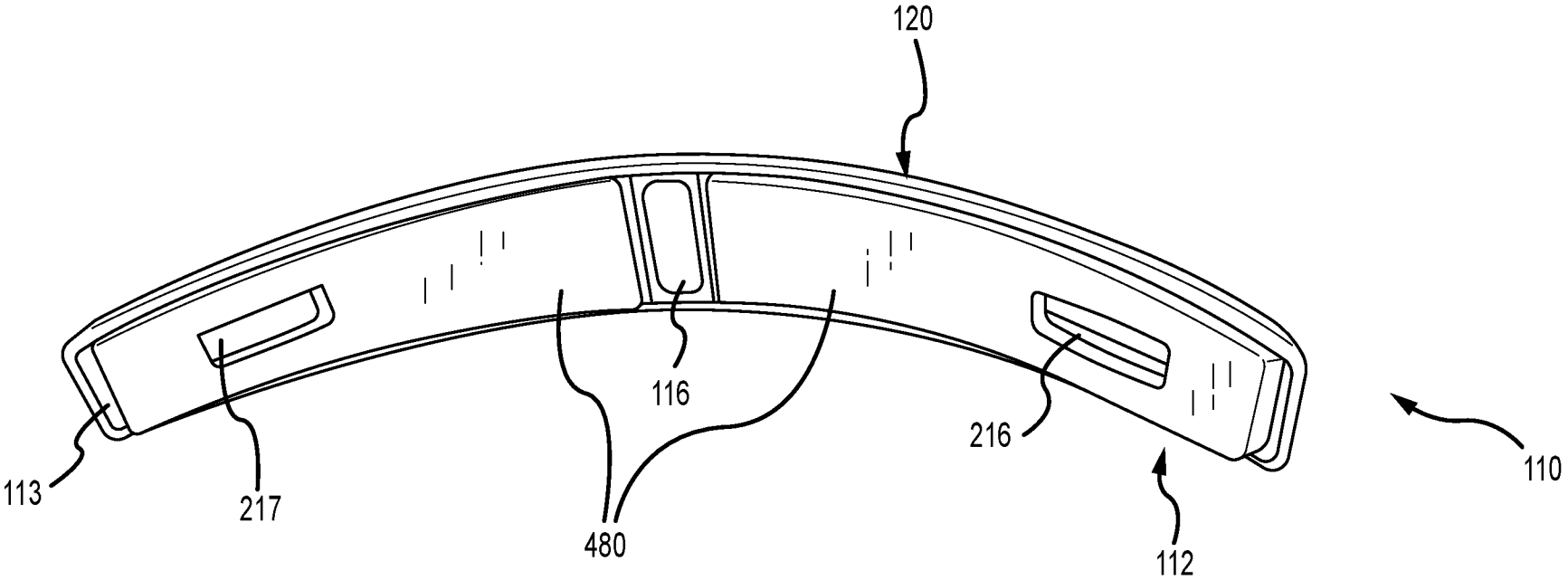
Figure 4C:
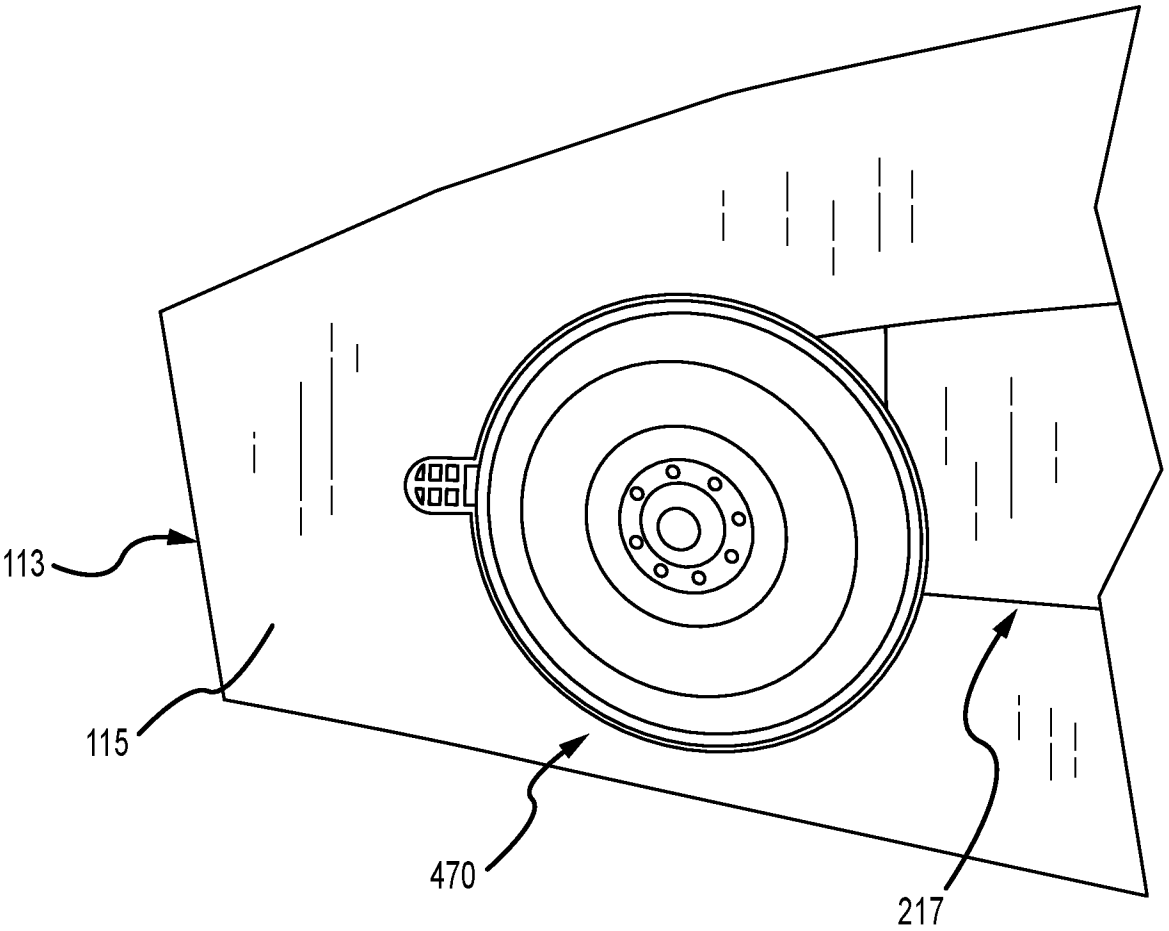

FIGS. 4A-4F illustrate various attachment means that may be used with the snap cover assembly 110 of FIG. 1 in addition or in place of the slots with flexible and sloped sidewalls of the inner or mounting element 112. FIG. 4A illustrates an embodiment of the assembly 110 in which a layer of flexible adhesive 450, such as foam tape adhesive or other flexible adhesive, is provided on all or portions of the inner or lower surface 115 of the body 113 of the inner or mounting element 112. As shown, the adhesive 450 may be provided in two sections or patches in the spaces between the inner slot 116 and the outer or side slots 216 and 217. The layer of adhesive acts as an additional attachment mechanism to the slot-snap coupling to hold the inner or lower surface 115 firmly against the outer spherical surface of the helmet. FIG. 4B illustrates an embodiment of the assembly 110 in which a layer of flexible adhesive 460 is applied in the spaces between the inner slot 116 and the outer slots 216 and 217 and also to surround the outer slots 216 and 217 so as to cover or substantially cover all of the inner or lower surface 115. In this embodiment, the adhesive layer 460 may be a flexible and removable silicone (or other type) adhesive, and it may take the form of double-sided tape (e.g., swatches of double-sided tape provided outside and between the slots, which may mate with the snaps or simply receive or house them (e.g., with an inner layer thickness or slot depth at least as great as the snap height) and facilitate alignment).

In some embodiments, the assembly 110 may be configured for attachment to helmets that do not include protruding male snaps. In such embodiments, the assembly 110 may take the form shown in FIG. 4C to include one or more plastic or rubber suction devices or cups 470, and these may be provided in a fixed or slidable manner in each of the slots 116, 216, and 217 with the surface-mating portion extending outward from the inner or lower surface 115.

Figure 4D:
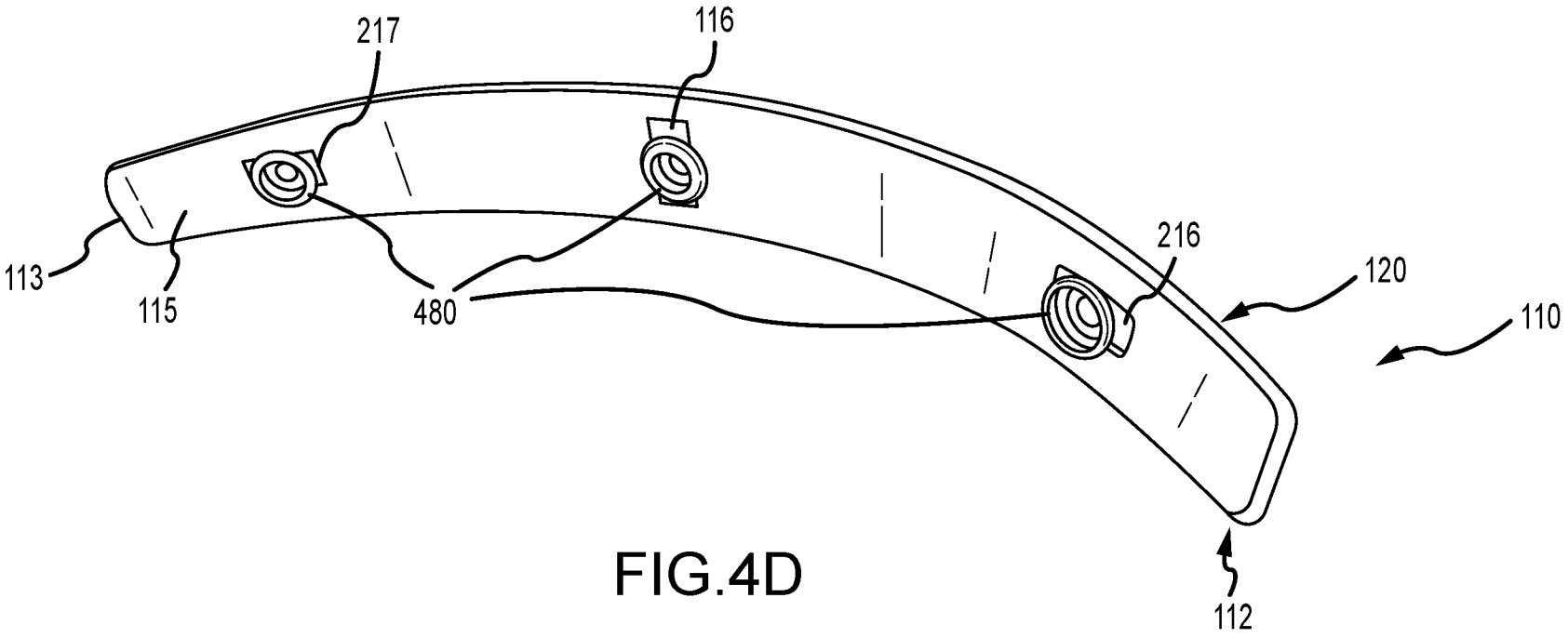

FIG. 4D illustrates another embodiment of snap cover assembly 110 in which a female snap 480 is positioned in each of the slots 116, 216, and 217. The three snaps 480 are sized to receive and mate with the visor or face shield snaps on a helmet, and the inner or mounting element 112 is detachable coupled to a helmet via snap-to-snap engagement rather than snap-to-slot sidewall engagement. The snaps 480 are preferably slidably received within the slots 116, 216, and 217 such that they can be slid at least some distance to account for differing helmet snap positions or mounting patterns (as discussed above with reference to FIGS. 2A and 2B).

Figure 4E:
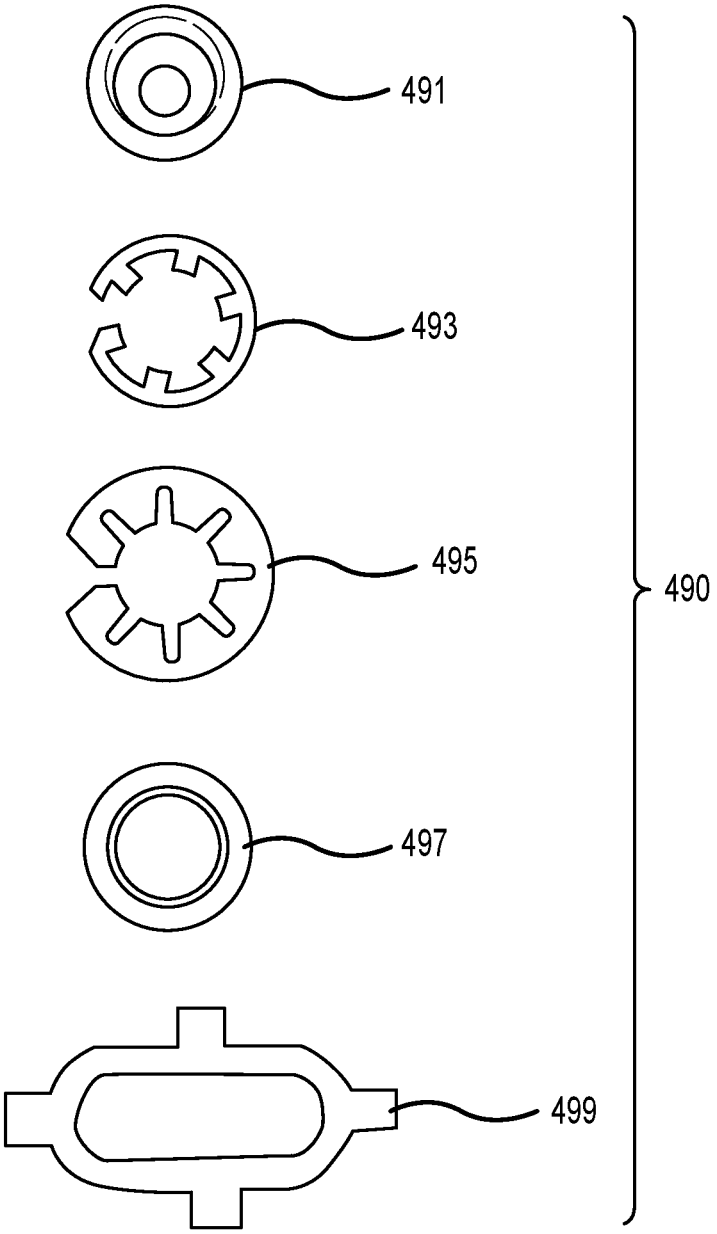

FIG. 4E illustrates a set of alternative snap coupling devices 490 that may be used in place of the flexible sidewalls of the slots 116, 216, and 217, with these components often but not in all cases being slidably positioned in the slots 116, 216, and 217 for attachment to a helmet snap. As shown, the snap coupling device 490 include a snap (e.g., female or male to be able to couple with the helmet snap), a press-on washer, a split washer, a custom metal flexure, and a metal flexible coupling device (which may provide the slot function and be placed into the body 113 of the inner or mounting element 112). In the same or other embodiments, the assembly 110 may be attached using glue or other adhesives in addition or in place of the snap-mating sidewalls of the slots 116, 216, and 217.

Figure 4F:
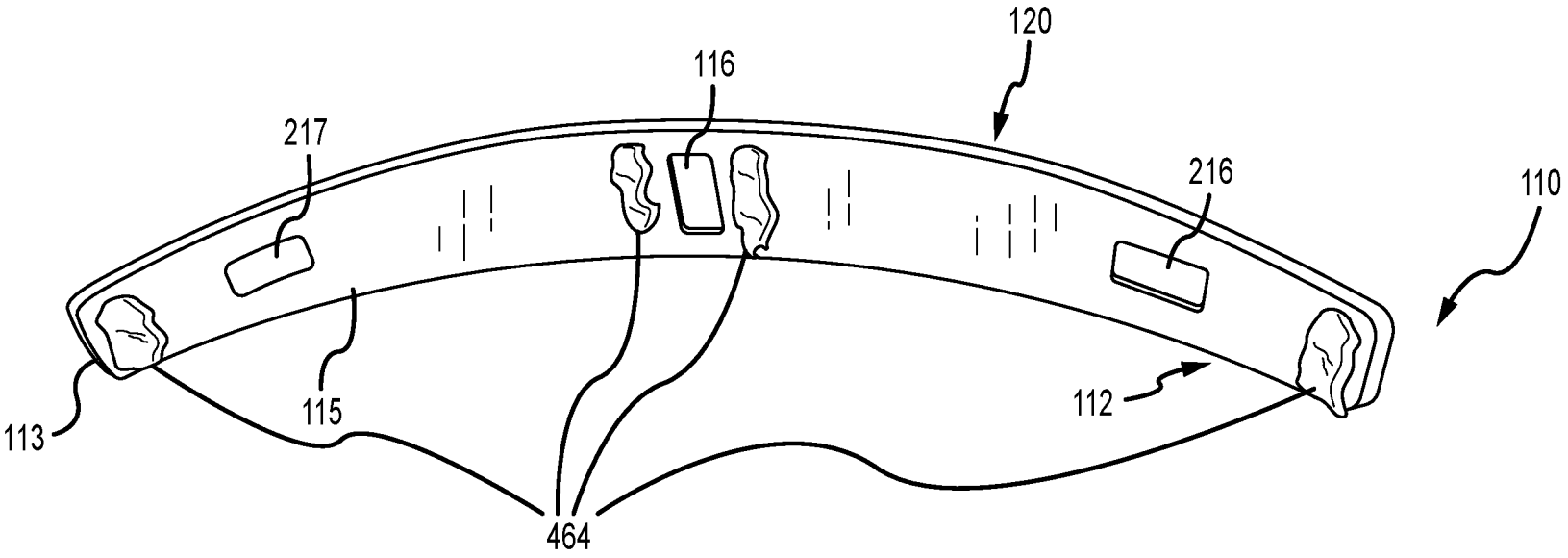

FIG. 4F illustrates such as assembly 110 that includes four patches of glue or adhesive 464 positioned exterior to the outer or side slots 216 and 217 and in the spaces between the center slot 116 and the outer or side slots 216 and 217. The glue may be provided in glue dots 464, and it may take a wide variety of forms including the type of adhesive used on the back of credit cars for removable or temporary applications to allow the assembly 110 to be detachable (e.g., to allow mounting of the visor or face shield on the helmet via reuse of the snaps).

Figure 5:
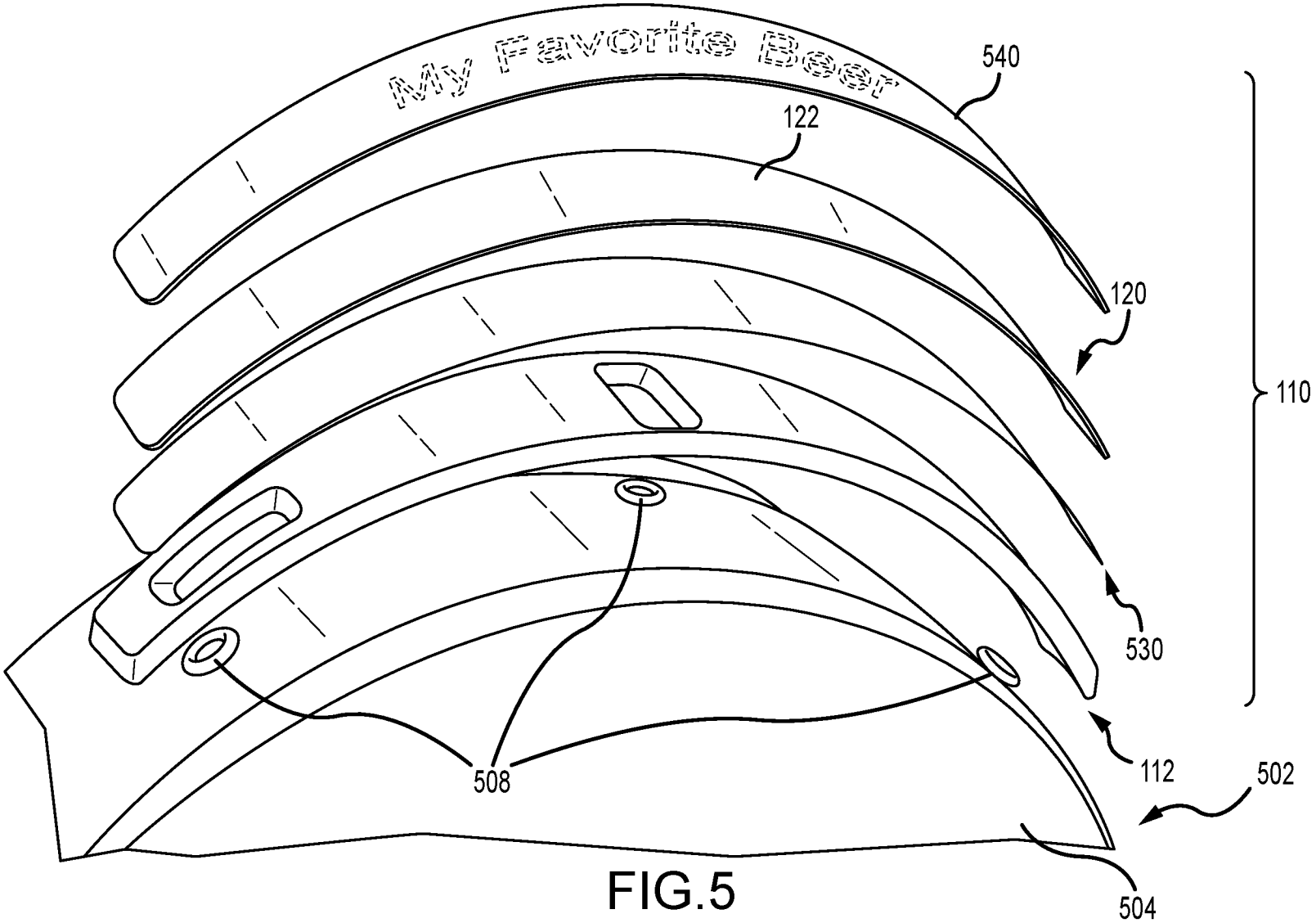
FIG. 5 illustrates an exploded or stack up view of the snap cover assembly of FIG. 1 as it may be attached or applied to an open face helmet such as a motorcycle helmet.

FIG. 5 illustrates an exploded or stack up view of the snap cover assembly 110 of FIG. 1 as it may be attached or applied to an open face helmet 502, e.g., a motorcycle helmet, a snowmobile helmet, an all-terrain vehicle (ATV), a jet ski helmet, or the like. As shown, the helmet 502 has an outer surface or shell 504 upon which are mounted three spaced apart snaps 508, which would be used to mount a visor or face shield (not shown) upon the helmet 502. With the snaps 508 exposed, the snap cover assembly 110 may be detachably mounted onto the helmet surface 504.

In this example, the assembly 110 include an inner or mounting element 112 with slots adapted for receiving and aligning the assembly 110 with the snaps 508 and also for mechanically coupling with the snaps 508 via their flexible and sloped or angled in sidewalls (as discussed in more detail with reference to FIGS. 1-2B. A layer of adhesive 530 is included in the assembly 110 to attach an outer element or cover layer 120 to the outer surface of the inner element 112, and the inner and outer elements 112 and 120 may be formed of a plastic or other flexible material, with the adhesive 530 being chosen to be compatible with this material(s). The outer element 120 includes an outer or customization surface 122 that is configured to include one or more customizations 540 such as via printing (e.g., a layer of ink), embossing, painting (e.g., a layer of paint, decals or stickers, molding, and/or the like. In some useful embodiments, the surface 122 is formed of retroreflective material or the customizations applied to the surface 122 are formed of retroreflective material for increased visibility and safety for the helmet wearer.

Figure 6:
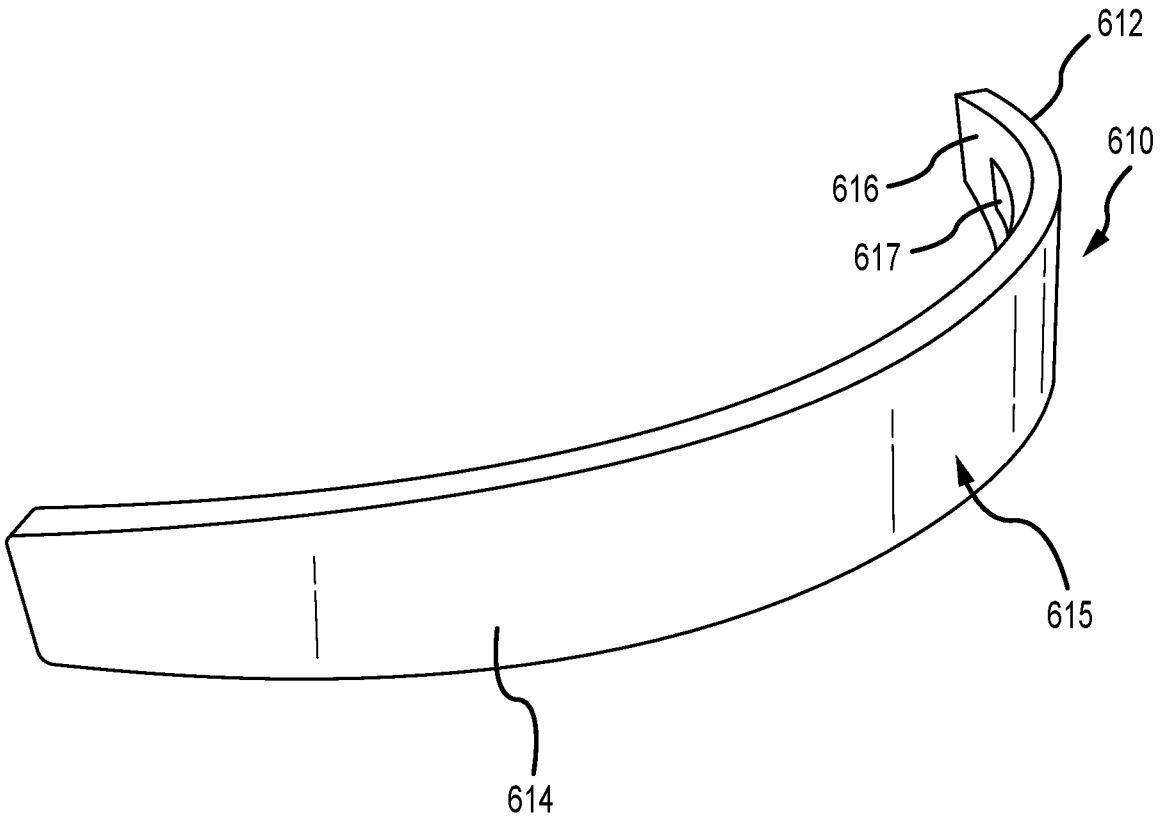
FIG. 6 illustrates another embodiment of the snap cover assembly in which the inner or mounting element and outer element with a customization surface are integrally formed or fabricated as a single-piece unit.

FIG. 6 illustrates another embodiment of a snap cover assembly 610 in which the inner or mounting element and outer element with a customization surface are integrally formed or fabricated as a single-piece unit such as via a plastic molding process, 3D printing, or other useful manufacturing process. This design is preferred in some applications to eliminate the need for attaching the inner and outer elements or layer together via an adhesive layer or the like, but this design does not facilitate use of the inner or mounting element with two or more outer or cover layers.

As shown, the assembly 610 is a single piece unit with a unitary body 612, which may be thought of as including both the inner or mounting element and the outer element/cover layer of the assembly 110 of FIG. 1. The body 612 includes an outer or customization surface 614, which in use would face away from the helmet to which the assembly 610 is attached, and, upon the outer or customization surface 614, a customization or customizing element 615 is provided in the form of a molded 3D element but other embodiments may use a printed/painted layer, a sticker/decal, an embossed feature, or the like to provide the customization or customizing element 615. The body 612 further includes an inner or mounting surface 616 upon which are formed three slots 616 each with integral snap features provided by the design of their flexible sidewalls (as discussed with reference to FIG. 1).

FIGS. 7A-7C illustrate an exploded view of another snap cover assembly 710 along with a perspective rear view and a side view of a slide-in lock clamp 730 of the assembly 710. This embodiment of the assembly 710 utilizes an independent or separable (non-integral) mechanism for coupling with the helmet snaps (or "buttons") 702. As shown, the assembly 710 includes a body 712 with an outer or customization surface 714 and an inner surface 716. As noted above, the body 712 may be a two-part design with an outer element or cover layer and an inner or mounting element with these two parts often being attached with an adhesive or adhesive layer, and the cover layer may have a recessed surface for receiving the inner or mounting element so that it may at least partially enclose the inner or mounting element (e.g., on all except the inner surface/side). In other cases, the body 712 may be of a unitary or one-piece design, as discussed with reference to FIG. 6.

The assembly 710 differs from assembly 110 in part because the slots are not used to couple with the helmet snaps but instead to receive, position/align, and retain a set of slide-in lock clamps 730. Three clamps 730 are included, with one per slot 720, 722, and 723 provided in the body 712 on the inner surface 716. Each clamp 730 is designed to receive and retain a button/snap 702 on an outer surface of a helmet (not shown).

To this end, the clamp 730 is shown to include a body or front leg 732 coupled with a back leg/arm 734 such as with an orthogonal relationship such that each clamp 730 is L-shaped, with the leg/arm 734 being much shorter in length (e.g., about matching the depth of the slots 720, 722, 723) than the body or front leg 732 (which may have a length of about 1.5 to 2.5 times that of the OD of the helmet snap/button). The body/front leg 732 includes a snap-receiving slot or groove 733 that is configured with an outer section designed to allow the smaller OD portion of a helmet button 702 to pass and an inner section designed to receive the larger head of the male snap 702, thereby capturing and retaining the snap 702 in a detachable or separable manner.

The rear leg/arm 734 has a width and height chosen to allow the clamps 730 to be received in the center slot 720 and the two outer or side slots 722 and 723. The center slot 720 may be sized with a width (as measured on the horizontal) that is only a small amount larger than the width of the leg/arm 734 (e.g., 5 to 10 percent larger) such that the clamp 730 inserted into the slot 720 has little or no side-to-side play or ability to move. In contrast, the side or outer slots 722 and 723 may have widths that are greater than the clamp's back leg/arm 734 width (such as 30 to 100 percent larger) to allow these clamps 730 inserted into these slots to be moved side-to-side to allow for differing helmet snap positions (as discussed above). In use, the clamps 730 may be first coupled or locked onto the three helmet snaps, and then the clamps 730 may be inserted into the slots 720, 722, and 723 with center slot 720 providing a horizontal or left-to-right positioning and outer slots 722 and 723 allowing for some movement of clamps 730. Once the alignment and/or sizing process is completed, the side-to-side movement of the clamps 730 in the slots 722 and 723 may be fixed such as with glue or other adhesive.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated. Thus, although illustrative example embodiments have been described herein with reference to the accompanying figures, it is to be understood that this description is not limiting and that various other changes and modifications may be affected therein by one skilled in the art without departing from the scope or spirit of the disclosure.

The snap cover assemblies described herein allow users to readily customize their open face helmets in a detachable or modifiable manner. The new assemblies act to "cover" helmet snaps or buttons that are exposed upon removal of a visor or face shield. The snap cover assembly is used by snapping it onto a helmet (e.g., a motorcycle helmet) using integral plastic snap mechanisms provided by each slot on an inner surface or via snap attachment components positioned in slots that do not have an integral snap mechanism. A covering layer may be integrally formed with the inner or mounting element or applied later via an adhesive layer or the like, and, similarly, one or more customizations or customizing elements may be provided on an outer or customization surface on the covering layer before or after the covering layer is attached to the inner or mounting element.

The customizations may provide optical customization of the helmet such as with a retroreflector or glowing surface (s). The customizations may be configured to provide public safety information such as "Ambulance," "Police," colors or symbols invoking escort or group leader functions or worker authority, or the like. The customizations may be configured to provide advertisement functions (e.g., "Soda Brand") and/or be configured to individualize or identify the helmet (e.g., with a badge number, a wearer's name, an ID number, a company affiliation, group representation (e.g., a tour group), favorite sports team or musical group, and so on). In some embodiments, the customization element may be configured or designed to be weather resistant or may include an additional outer layer/coating of weather resistant material.

We claim:

1. A snap cover assembly for use with open face helmets, comprising:

an inner mounting element with a semi-cylindrical body having an inner surface and an outer surface, wherein the inner surface and the outer surface are separated by a radial height;

an outer customization element with a semi-cylindrical body attached to or integrally formed with the outer surface of the body of the inner mounting element, wherein the body of the outer customization element comprises a customization surface disposed opposite the inner mounting element that is configured for receiving or containing one or more customizing elements; and a set of spaced-apart slots provided in the inner surface of the inner mounting element that are configured for receiving a set of snaps provided on an outer surface of an open face helmet for coupling with a visor or face shield, wherein each snap of the set of snaps has a snap height not exceeding the radial height separating the inner surface and the outer surface of the semi-cylindrical body of the inner mounting element.

2. The assembly of claim 1, wherein each of the slots is defined by a flexible sidewall configured for providing a snap fit with one of the snaps.

3. The assembly of claim 2, wherein the flexible sidewall is angled inward from the outer surface to the inner surface of the body of the inner mounting element to provide the snap fit.

4. The assembly of claim 1, wherein each of the slots has a length that is at least 1.5 times greater than a maximum outer diameter of the snaps.

5. The assembly of claim 4, wherein the set of slots comprises three elongated slots with a center slot positioned proximate to a center of the body of the inner mounting element and being arranged with a longitudinal axis substantially orthogonal to a longitudinal axis of the body of the inner mounting element, and wherein the three elongated slots include a pair of outer slots positioned with one on either side of the center slot and each oriented with a longitudinal axis substantially parallel to the longitudinal axis of the body of the inner mounting element.

6. The assembly of claim 1, further comprising a snap coupling device slidably disposed within each of the slots, wherein the snap coupling device comprises at least one of a female or male snap configured for mating with the snap of the helmet, a press-on washer, a split washer, a metal flexure, or a metal flexible coupling device.

7. The assembly of claim 1, further comprising a suction cup disposed within each of the slots that is oriented and configured for mating with the outer surface of the helmet.

8. The assembly of claim 1, further comprising one or more patches or a layer of flexible adhesive on the inner surface of the mounting element.

9. The assembly of claim 1, further comprising a customizing element attached to or provided as part of the customization surface, wherein the customizing element comprises at least one of a retroreflector or layer of retroreflective material, a sticker, a decal, a layer of ink, a layer of paint, a three dimensional (3D) component, an embossed element, a molded element, a feature configured for providing public safety information, a feature providing colors or symbols invoking escort or group leader functions or worker authority, a component providing advertisement functions, a component configured to individualize or identify the helmet or person wearing the helmet, or a customization with an outer layer or coating of weather resistant material.

10. A snap cover assembly for use with open face helmets, comprising:

an inner mounting element with a semi-cylindrical body having an inner surface and an outer surface, wherein the inner surface and the outer surface are separated by a radial height;

an outer customization element with a semi-cylindrical body attached to or integrally formed with the outer surface of the body of the inner mounting element, wherein the body of the outer customization element comprises a customization surface disposed opposite the inner mounting element that is configured for receiving or containing one or more customizing elements; and a set of slots provided on the inner surface of the inner mounting element that are configured for receiving a set of snaps provided on an outer surface of an open face helmet for coupling with a visor or face shield, wherein each snap of the set of snaps has a snap height not exceeding the radial height separating the inner surface and the outer surface of the semi-cylindrical body of the inner mounting element, wherein the set of slots comprises three elongated slots with a center slot positioned proximate to a center of the body of the inner mounting element and being arranged with a longitudinal axis substantially orthogonal to a longitudinal axis of the body of the inner mounting element, and wherein the three elongated slots include a pair of outer slots positioned with one on either side of the center slot and each oriented with a longitudinal axis substantially parallel to the longitudinal axis of the body of the inner mounting element.

11. The assembly of claim 10, further comprising a snap coupling device slidably disposed within each of the slots that is configured for mating with a snap or button provided on an outer surface of an open face helmet to attach a visor or face shield to the helmet.

12. The assembly of claim 11, wherein the snap coupling device comprises at least one of a female or male snap configured for mating with the snap of the helmet, a press-on washer, a split washer, a metal flexure, or a metal flexible coupling device.

13. The assembly of claim 10, further comprising a suction cup disposed within each of the slots that is oriented and configured for mating with the outer surface of the helmet.

14. The assembly of claim 10, further comprising one or more patches or a layer of flexible adhesive on the inner surface of the mounting element.

15. The assembly of claim 10, further comprising a customizing element attached to or provided as part of the customization surface, wherein the customizing element comprises at least one of a retroreflector or layer of retroreflective material, a sticker, a decal, a layer of ink, a layer of paint, a three dimensional (3D) component, an embossed element, a molded element, a feature configured for providing public safety information, a feature providing colors or symbols invoking escort or group leader functions or worker authority, a component providing advertisement functions, a component configured to individualize or identify the helmet or person wearing the helmet, or a customization with an outer layer or coating of weather resistant material.

* * * * *